US010067445B2

(12) United States Patent
Shibata

(10) Patent No.: US 10,067,445 B2
(45) Date of Patent: Sep. 4, 2018

(54) DEVELOPING DEVICE AND IMAGE FORMING APPARATUS WITH A MAGNETICALLY CHARGED COLLECTION MEMBER

(71) Applicant: FUJI XEROX CO., LTD., Tokyo (JP)

(72) Inventor: Tomohiro Shibata, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/257,031

(22) Filed: Sep. 6, 2016

(65) Prior Publication Data

US 2017/0227891 A1 Aug. 10, 2017

(30) Foreign Application Priority Data

Feb. 4, 2016 (JP) ..... 2016-019758

(51) Int. Cl.
*G03G 15/09* (2006.01)
*G03G 15/095* (2006.01)
*G03G 21/20* (2006.01)

(52) U.S. Cl.
CPC ..... *G03G 15/0907* (2013.01); *G03G 15/0942* (2013.01); *G03G 15/095* (2013.01); *G03G 15/0921* (2013.01); *G03G 21/206* (2013.01)

(58) Field of Classification Search
CPC ..... G03G 15/0907; G03G 15/0898; G03G 15/09; G03G 15/0921
USPC ..... 399/270
See application file for complete search history.

(56) References Cited

U.S. PATENT DOCUMENTS 4,545,325 A * 10/1985 Komatsu ..... G03G 15/0126 399/231

FOREIGN PATENT DOCUMENTS

| | | | |
|---|---|---|---|
| JP | 63198087 A | * | 8/1988 |
| JP | 2006-250973 A | | 9/2006 |
| JP | 2008-026487 A | | 2/2008 |
| JP | 2008-209788 A | | 9/2008 |

* cited by examiner

*Primary Examiner* — Billy Lactaoen
(74) *Attorney, Agent, or Firm* — Oliff PLC

(57) ABSTRACT

According to an aspect of the invention, a developing device includes a developer holding member that holds developer including toner which is charged to have a predetermined polarity on a surface and performs development of an electrostatic latent image with respect to an image holding member which holds the electrostatic latent image while being rotated; a storage member that stores the developer therein and has an opening portion for discharging air in which flow is generated by the rotation of the developer holding member; and a collection member that is provided in the opening portion of the storage member to be charged to the predetermined polarity, causes air to pass therethrough, and collects toner.

15 Claims, 8 Drawing Sheets

DEVELOPING DEVICE AND IMAGE FORMING APPARATUS WITH A MAGNETICALLY CHARGED COLLECTION MEMBER

CROSS-REFERENCE TO RELATED APPLICATIONS

This application is based on and claims priority under 35 USC 119 from Japanese Patent Application No. 2016-019758 filed Feb. 4, 2016.

BACKGROUND

Technical Field

The present invention relates to a developing device and an image forming apparatus.

SUMMARY

According to an aspect of the invention, there is provided a developing device including:

a developer holding member that holds developer including toner which is charged to have a predetermined polarity on a surface and performs development of an electrostatic latent image with respect to an image holding member which holds the electrostatic latent image while being rotated;

a storage member that stores the developer therein and has an opening portion for discharging air in which flow is generated by the rotation of the developer holding member; and a collection member that is provided in the opening portion of the storage member to be charged to the predetermined polarity, causes air to pass therethrough, and collects toner.

BRIEF DESCRIPTION OF THE DRAWINGS

Exemplary embodiments of the present invention will be described in detail based on the following figures, wherein.

DETAILED DESCRIPTION

Description of Image Forming Apparatus

Hereinafter, an exemplary embodiment will be described in detail with reference to the drawings.

Figure 1:
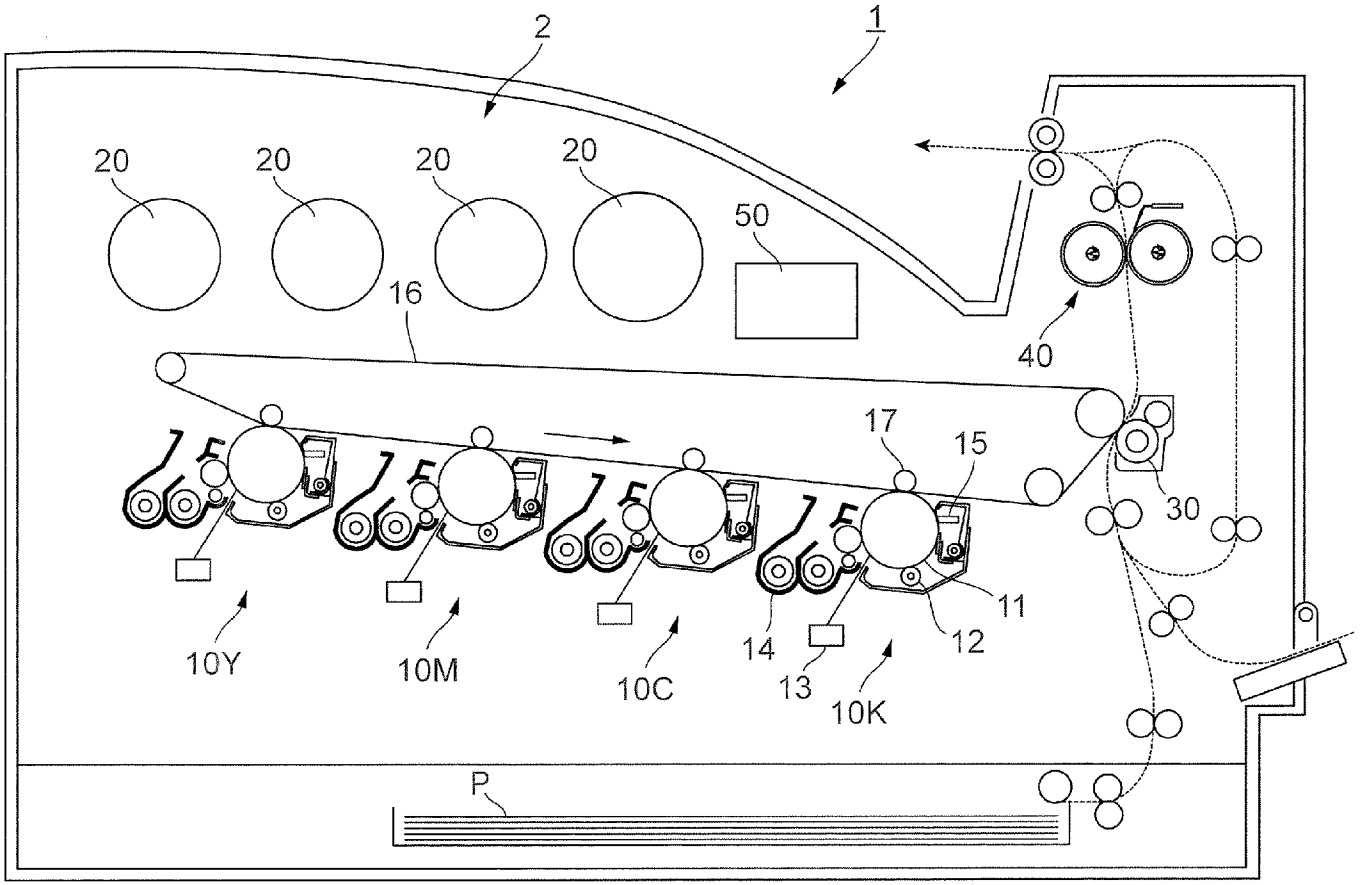
FIG. 1 is a view illustrating an example of a configuration of an image forming apparatus to which an exemplary embodiment is applied.
Figure 2:
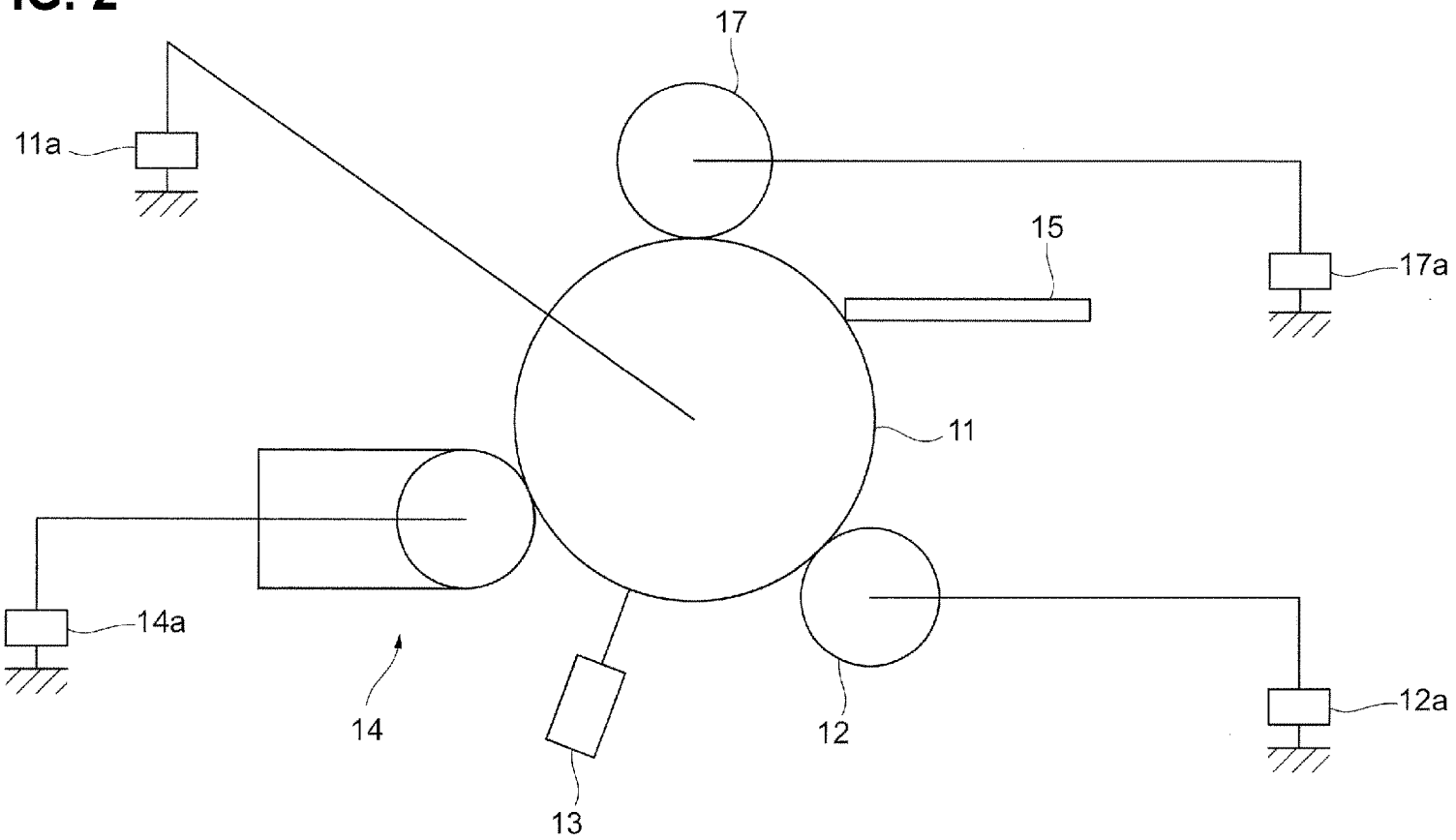
FIG. 2 is an enlarged view illustrating a part of the image forming apparatus.

FIG. 1 is a schematic configuration view illustrating an image forming apparatus 1 to which the exemplary embodiment is applied. In addition, FIG. 2 is an enlarged view illustrating a part of the image forming apparatus 1.

The image forming apparatus 1 is provided with plural image forming units 10 (10Y, 10M, 10C, and 10K) of yellow (Y), magenta (M), cyan (C), and black (K) as an aspect of an image forming portion that is disposed in an image forming space 2. Each of the image forming units 10 is integrally formed with a photoreceptor drum 11 that is an example of an image holding member and various electrophotographic devices that are sequentially arranged around the photoreceptor drum 11, and is a so-called to be cartridge. The integrally formed electrophotographic device includes, for example, a charging roll 12 that charges the photoreceptor drum 11, an exposure unit 13 that forms an electrostatic latent image by exposing a surface of the photoreceptor drum 11 which is charged by the charging roll 12, a developing unit 14 as an example of a developing device for developing the electrostatic latent image formed on the photoreceptor drum 11 by the exposure unit 13, a cleaning device 15 that removes waste toner on the photoreceptor drum 11, and the like. However, for example, only the developing unit 14 is made to be a separate structure and may also be a separate structure from the cartridge of the photoreceptor drum 11 when the image forming unit 10 is to be a cartridge.

The image forming apparatus 1 includes an intermediate transfer belt 16 in which each color toner image formed by the photoreceptor drum 11 of each image forming unit 10 is multiply-transferred and a first transfer roll 17 which sequentially transfers (primarily transfers) each color toner image formed by each image forming unit 10 to the intermediate transfer belt 16. Furthermore, the image forming apparatus 1 includes a second transfer roll 30 which collectively transfers (secondarily transfers) the toner image formed by being superimposed on the intermediate transfer belt 16 to a sheet P that is the recording medium (recording sheet). In addition, the image forming apparatus 1 includes a fixing unit 40 that fixes the secondarily transferred toner image on the sheet P. Furthermore, the image forming apparatus 1 has a toner cartridge 20 that supplies the toner on the developing unit 14 of each of the image forming units 10 (10Y, 10M, 10C, and 10K). In addition, the image forming apparatus 1 includes a control section 50 that controls the entire image forming apparatus 1.

The photoreceptor drum 11 that is an example of the image holding member is made by forming an organic photosensitive layer on a surface of a thin cylindrical drum made of metal and is configured of a material of which the organic photosensitive layer is charged to a negative polarity. Then, development by the developing unit 14 is performed by an inversion development system. Therefore, the toner used in the developing unit 14 is a negative polarity charge type.

A photoreceptor bias power supply 11*a* that applies a predetermined cleaning bias to the photoreceptor drum 11 is connected to the photoreceptor drum 11. The photoreceptor bias power supply 11*a* applies the cleaning bias of the negative polarity to a portion of the charged photoreceptor drum 11 which is not exposed and thereby the portion of the charged photoreceptor drum 11 which is not exposed is prevented from being adhered by the toner by an electrostatic force.

The charging roll 12 charges the photoreceptor drum 11 to a predetermined charge. In addition, a charge bias power supply 12*a* that applies a predetermined charge bias to the charging roll 12 is connected to the charging roll 12. The charge bias power supply 12*a* applies the charge bias of the negative polarity to the charging roll 12 and thereby the charging roll 12 is charged to the negative polarity.

A development bias power supply 14*a* that charges the developing unit 14 to a predetermined potential is connected to the developing unit 14. The development bias power supply 14*a* applies a predetermined development bias to the developing unit 14. Then, in a development region closest to the photoreceptor drum 11, the toner is transferred from a developer layer on the developing unit 14 to a latent image forming region on the photoreceptor drum 11. Therefore, the electrostatic latent image is visible as the toner image by being developed. Moreover, a configuration of the developing unit 14 will be described later.

A transfer bias power supply 17*a* that applies a predetermined transfer bias to the first transfer roll 17 is connected to the first transfer roll 17. The transfer bias power supply 17*a* applies the predetermined transfer bias to the first transfer roll 17 and thereby the first transfer roll 17 is charged to a positive potential.

The image forming apparatus 1 performs a series of image forming processes under an operation control by the control section 50. That is, an imaging process is executed on image data obtained from a PC, a scanner, and the like by an image processing portion (not illustrated). The image data becomes image data of each color and then is transmitted to the exposure unit 13. Then, in each image forming unit 10, exposure is received by the exposure unit 13, development is performed by the developing unit 14, and the toner image is formed on the photoreceptor drum 11. The toner image of each color formed on the photoreceptor drum 11 of each image forming unit 10 is sequentially electrostatically transferred (primarily transferred) on the intermediate transfer belt 16 by the first transfer roll 17, each color toner T is superimposed, and thereby a superimposed toner image is formed. A superimposed toner image on the intermediate transfer belt 16 is transported to a second transfer region in which the second transfer roll 30 is disposed in accordance with the movement of the intermediate transfer belt 16. On the other hand, the sheet P is fed in accordance with a transport timing of the superimposed toner image and is transported to the second transfer region. Then, the superimposed toner image on the intermediate transfer belt 16 is collectively and electrostatically transferred (secondarily transferred) on the transported sheet P by a transfer electric field formed by the second transfer roll 30 in the second transfer portion. The sheet P to which the superimposed toner image is electrostatically transferred is transported to the fixing unit 40 and the superimposed toner image is fixed on the sheet P by the fixing unit 40. After the superimposed toner image is fixed, the sheet P is transported to a sheet stacking portion provided in an exit portion of the image forming apparatus 1.

Description of Developing Unit

Next, the developing unit 14 will be described in detail.

Figure 3:
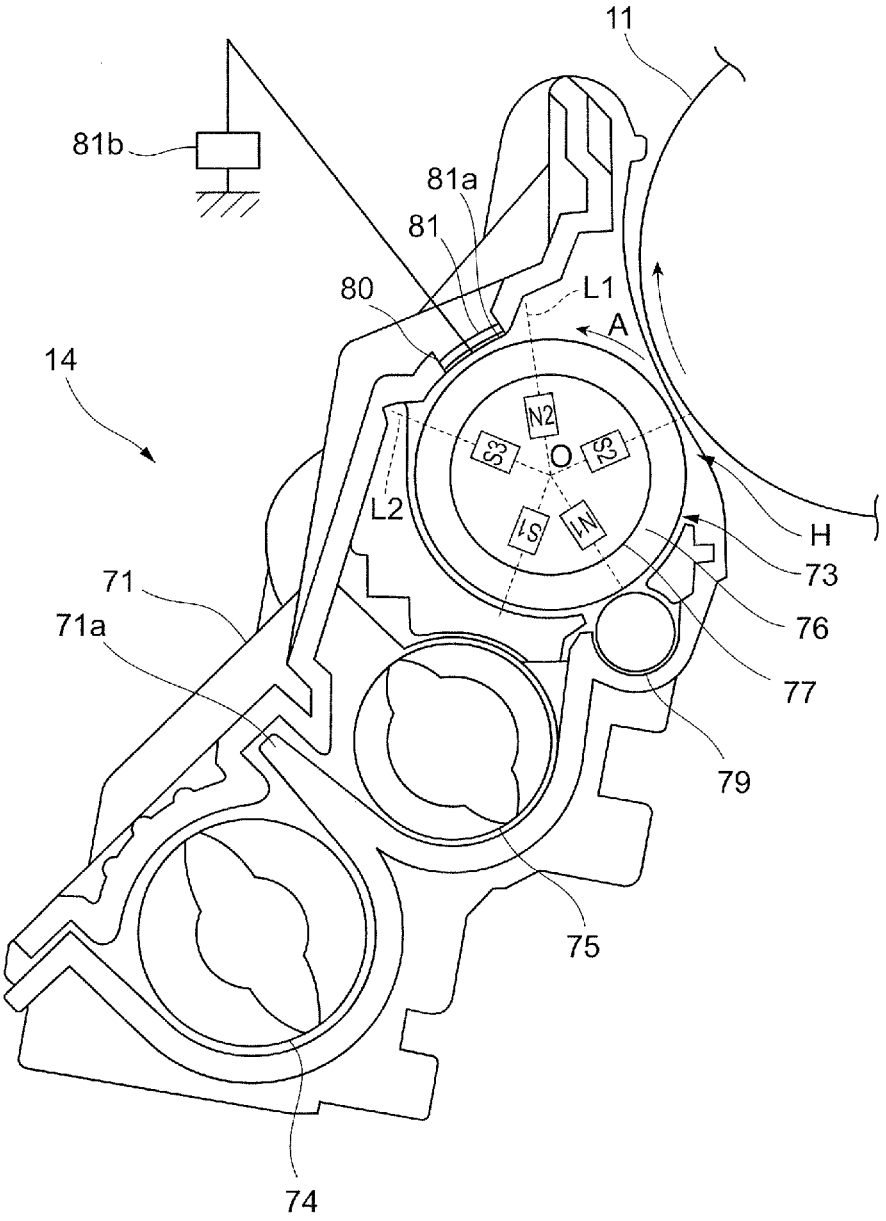
FIG. 3 is a view illustrating a configuration of a developing unit.

FIG. 3 is a view illustrating a configuration of the developing unit 14.

The developing unit 14 includes a development housing 71 as an example of a storage member which has an opening portion H (development opening) facing the photoreceptor drum 11 and stores, for example, two-component developer (not illustrated) including toner charged to the negative polarity and a carrier charged to the positive polarity on the inside thereof. In addition, the developing unit 14 includes a developing roll 73 as an example of a developer holding member which is disposed in a portion to face the opening portion H of the development housing 71, is disposed to be rotated to the photoreceptor drum 11, and forms the toner image by developing the electrostatic latent image.

Furthermore, the developing unit 14 includes a pair of screw augers 74 and 75 which are disposed substantially parallel in an axial direction of the photoreceptor drum 11 on a rear lower side of the developing roll 73 viewed from the photoreceptor drum 11 in the development housing 71 and transport the developer to the developing roll 73. Moreover, in the following description, the screw auger 74 that is far from the developing roll 73 is referred to as a first screw auger 74 and the screw auger 75 close to the developing roll 73 is referred to as a second screw auger 75. Furthermore, the developing unit 14 includes a trimmer 79 which is disposed below the developing roll 73 having a predetermined distance from the developing roll 73 and regulates a thickness of the developer layer on the developing roll 73.

A supply port (not illustrated) that supplies new developer supplied from the toner cartridge 20 and an exit port (not illustrated) that discharges excess developer are formed in the development housing 71. In addition, a partition wall 71*a*, which partitions the first screw auger 74 and the second screw auger 75, and connects both end portions to each other, is provided in the development housing 71. Then, both the first screw auger 74 and the second screw auger 75 are configured to mount spiral blades around rotation shafts extending in a direction perpendicular to a surface of paper.

Furthermore, in the development housing 71, an opening portion 80 (ventilation opening) is provided above the developing roll 73 and on a downstream side in the rotating direction of the developing roll 73 from the photoreceptor drum 11. Then, the opening portion 80 is covered by a ventilation filter 81 which has a semiconductive property and separates the toner and air toward the opening portion 80.

The opening portion 80 discharges air in which air flow is generated by the rotation of the developing roll 73 and prevents the air flow from being directed to the photoreceptor drum 11. Moreover, the ventilation filter 81 will be described later.

The developing roll 73 has a developing sleeve 76 which is rotatably disposed and a magnet roll 77 which is fixedly disposed on an inside of the developing sleeve 76 and in which plural magnetic poles are arranged inside. The developing sleeve 76 is driven by a motor (not illustrated) to be rotated in an arrow A direction in the figure and is rotated in the same direction as that of the photoreceptor drum 11 in the counterclockwise direction in the figure in a developing position facing the photoreceptor drum 11.

Magnetic poles S1 to S3, N1, and N2 of 5 poles are formed along an outer peripheral surface in the magnet roll 77. Here, the magnetic pole S1 (pickup pole) has a function of adsorbing the developer that is agitated and transported by the second screw auger 75 of the developing sleeve 76. The magnetic pole N1 (trimming pole) has a function of forming the developer layer on the outer peripheral surface of the developing sleeve 76. In addition, the magnetic pole S2 (development pole) has a function of moving the toner from the surface of the developing sleeve 76 to the photoreceptor drum 11 and developing the electrostatic latent image which is formed on the surface of the photoreceptor drum 11. Furthermore, the magnetic pole N2 (transport pole) has a function of transporting the developer in accordance with the rotation of the developing sleeve 76 by maintaining the adsorption of the developer with respect to the surface of the developing sleeve 76. Then, the magnetic pole S3 (pickoff pole) has a function of forming a repulsive magnetic field with the adjacent magnetic pole S1 (pickup pole) and separating the developer adsorbed on the developing sleeve 76 from the developing sleeve 76.

In addition, plural magnetic poles within the magnet roll 77 are arranged such that the opening portion 80 is positioned between an extension line L1 that is a line passing through the magnetic pole N2 from the rotational center O of the developing roll 73 and intersecting the outer peripheral surface of the developing sleeve 76, and an extension line L2 that is a line passing through the magnetic pole S3 from the rotational center O of the developing roll 73 and intersecting the outer peripheral surface of the developing sleeve 76.

The second screw auger 75 is rotated so as to agitate and transport the developer within the development housing 71 in one direction. In addition, the first screw auger 74 is rotated so as to agitate and transport the developer within the development housing 71 in the opposite direction. Therefore, the developer within the development housing 71 is transported in a circulated manner within the development housing 71 while being agitated by the first screw auger 74 and the second screw auger 75. The toner having the negative charge polarity is agitated and transported with the carrier having the positive charge polarity, and thereby is rubbed and is charged to the negative polarity.

Description of Ventilation Filter

Next, the ventilation filter 81 provided in the opening portion 80 of the development housing 71 will be described.

The ventilation filter 81 as an example of a collection member is used, for example, as created by weaving non-conductive fibers such as a nylon line in a mesh shape. Meshes of the ventilation filter 81 are configured to be finer than the toner existing within the developing unit 14. If air including the toner flows through the ventilation filter 81, air passes through the ventilation filter 81 and is discharged to the outside of the developing unit 14. On the other hand, the toner is rejected or enters into the mesh of the ventilation filter 81 and is prevented from being discharged to the outside of the developing unit 14.

In addition, a surface of the ventilation filter 81 facing the developing roll 73 is, for example, coated with Teflon (registered trademark) and is provided with a charging portion 81*a* having the semiconductive property. The charging portion 81*a* is provided above the developing roll 73 and faces downward that is a direction in which the developing roll 73 is disposed. Moreover, a configuration of the charging portion 81*a* may have the semiconductive property and is not limited to Teflon. The ventilation filter 81 has the semiconductive property by the charging portion 81*a*.

Then, a filter bias power supply 81*b* charging the charging portion 81*a* to a predetermined potential is connected to the charging portion 81*a*. The filter bias power supply 81*b* as an example of a voltage application member applies a predetermined filter bias to the charging portion 81*a* and thereby the charging portion 81*a* is charged to the negative polarity. Therefore, in a case where the toner that is charged to the negative polarity exists in the vicinity of the charging portion 81*a* that is charged to the negative polarity, the toner receives a repulsive force from the charging portion 81*a*. The toner which receives the repulsive force is separated from the charging portion 81*a* and falls downward under gravity.

Description of Movement of Developer being Scattered by Rotation of Developing Roll Next, a movement of the developer that is scattered by the rotation of the developing roll 73 will be described.

Figure 4A:
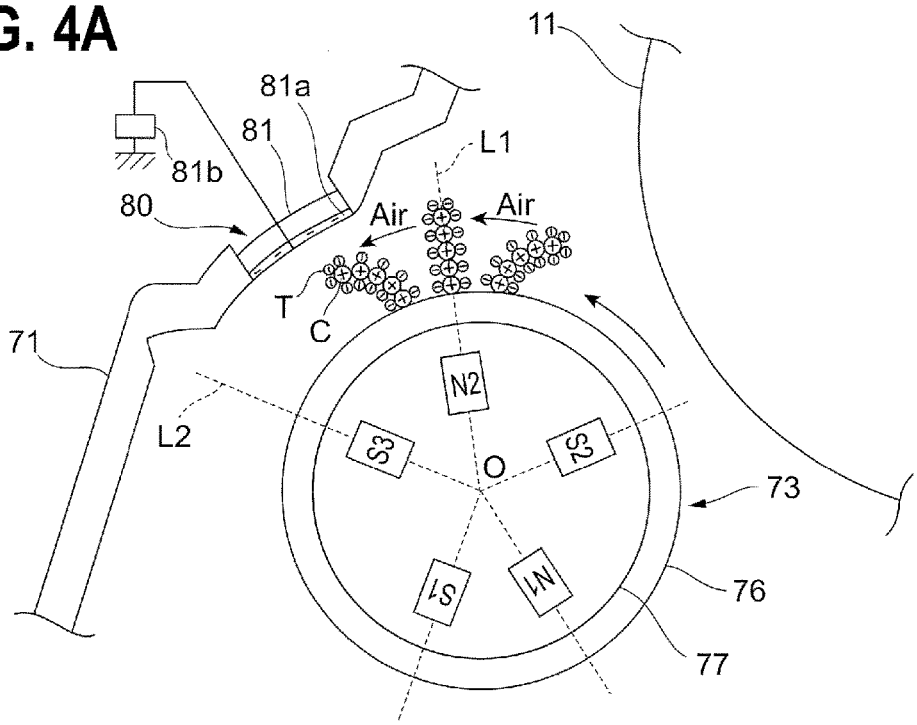
FIGS. 4A to 4C are views illustrating a movement of toner scattered by a rotation of a developing roll.
Figure 4B:
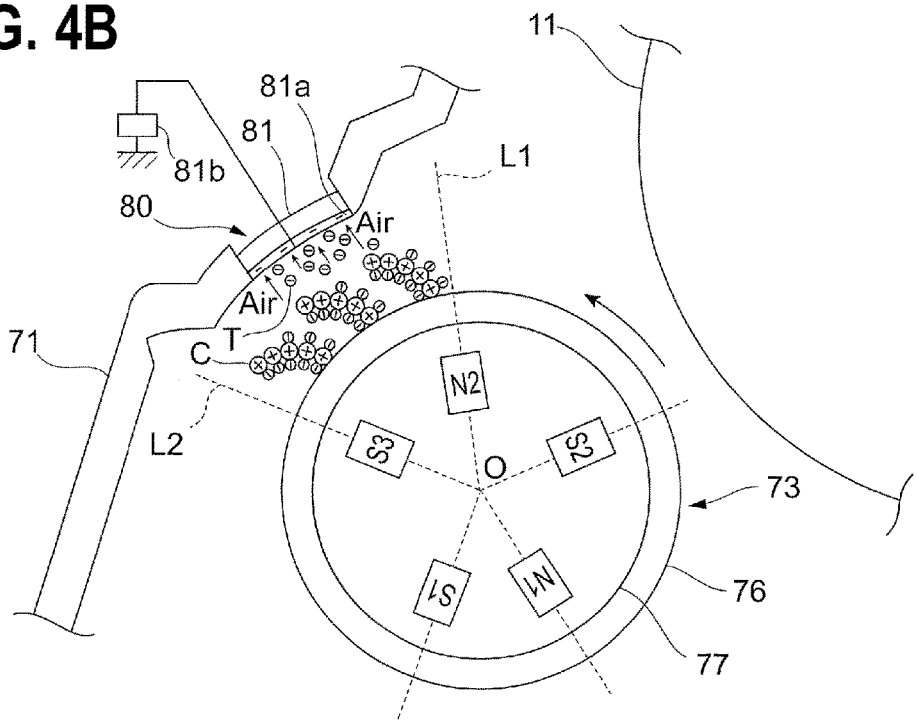
Figure 4C:
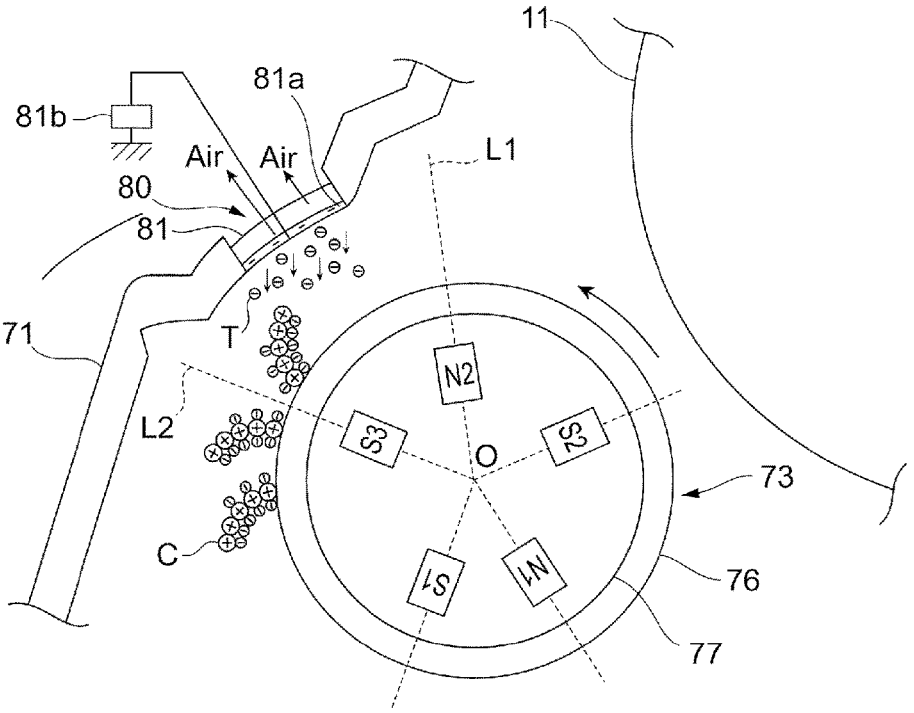

FIGS. 4A, 4B, and 4C are views illustrating the movement of the toner (hereinafter, referred to as toner T) scattered by the rotation of a developing roll 73.

First, the filter bias power supply 81*b* applies a voltage of the negative polarity to the charging portion 81*a* of the ventilation filter 81. Here, the voltage applying to the charging portion 81*a* is, for example, −100 V. A value of the voltage applying to the charging portion 81*a* by the filter bias power supply 81*b* is a value of a predetermined range in which the ventilation filter 81 applies the repulsive force to toner T existing in the vicinity thereof without attracting the carrier (hereinafter, referred to as a carrier C) existing in the vicinity thereof.

Then, the developing roll 73 is rotated and, as development of the electrostatic latent image formed on the photoreceptor drum 11, the toner T on the developing roll 73 is moved to the photoreceptor drum 11.

Thereafter, the toner T passed through the photoreceptor drum 11 while being held by the developing roll 73 without being moved to the photoreceptor drum 11 is directed on the downstream side in the rotating direction of the developing roll 73 from the photoreceptor drum 11 (see FIG. 4A).

Here, the developer positioned on the extension line L1 forms napping by receiving a magnetic force from the magnetic pole N2. On the other hand, the developer before or after passing through the extension line L1 has a weak magnetic force received from the magnetic pole N2 and is fallen. In addition, the flow of air is generated around the developing roll 73 by the rotation of the developing roll 73.

Then, the toner T held by the developing roll 73 receives an inertial force generated by the rotation of the developing roll 73 and is scattered to the opening portion 80 provided in the development housing 71 (see FIG. 4B). In addition, air, in which the flow is generated by the rotation of the developing roll 73, is directed to the opening portion 80 by taking the toner T existing around thereof.

In a case where a distance between the ventilation filter 81 and the toner T is distant, the toner T is not affected by the electric charge of the negative polarity to which the charging portion 81*a* is charged. However, the toner T that enters the meshes of the ventilation filter 81 and causes clogging of the meshes, and the toner T that exists in the vicinity of the ventilation filter 81 receive the repulsive force from the charging portion 81*a* that is charged to the electric charge of the negative polarity. In addition, a force directing downward by the gravity acts on the toner T.

Therefore, the toner T adhering to the ventilation filter 81 or approaching the ventilation filter 81 is directed downward by receiving the forces (see FIG. 4C). Then, the toner T adheres to the developing roll 73 or falls downward from the developing roll 73. On the other hand, air which is not affected by the electric charge of the negative polarity to which the charging portion 81*a* is charged is discharged to the outside of the developing unit 14 through the meshes of the ventilation filter 81.

Toner falling within the development housing 71 is transported to the developing roll 73 while being agitated by the first screw auger 74 and the second screw auger 75. Then, toner adhering to the developing roll 73 is used again for development of the electrostatic latent image formed on the photoreceptor drum 11.

As described above, in the exemplary embodiment, the ventilation filter 81 covering the opening portion 80 of the development housing 71 is charged to the negative polarity. Therefore, toner T adhering to the ventilation filter 81 or existing in the vicinity of the ventilation filter 81 receives the repulsive force from the ventilation filter 81 and is moved in a direction separated from the ventilation filter 81. Thus, it is possible to suppress that an amount of adhesion of the toner to the ventilation filter 81 is accumulated.

In addition, in the exemplary embodiment, the ventilation filter 81 covering the opening portion 80 is disposed above the developing roll 73. Then, the charging portion 81*a* configuring the surface of the ventilation filter 81 is directed downward. Thus, toner T directed from the developing roll 73 to the ventilation filter 81 and toner T adhering to the charging portion 81*a* are likely to be fallen by receiving influence of the gravity.

Furthermore, the fallen toner T is used again for development. Therefore, an amount of the toner T to be discarded due to the replacement of the ventilation filter 81 is reduced.

Moreover, in order to reduce the influence of air in which flow is generated by the rotation of the developing roll 73, it is preferable that the position of the opening portion 80 provided in the development housing 71 is close to the developing roll 73. On the other hand, in a case where the opening portion 80 is excessively close to the developing roll 73, the developer on the developing roll 73 comes into contact with the ventilation filter 81 covering the opening portion 80 and thereby there is a concern that the ventilation filter 81 is damaged. In addition, there is a concern that the developer is scattered due to the contact with the ventilation filter 81.

Thus, in the exemplary embodiment, the ventilation filter 81 covering the opening portion 80 provided in the development housing 71 is disposed between the extension line L1 and the extension line L2. Therefore, the developer held by the developing roll 73 is in the state of being fallen in a position that is closest to the ventilation filter 81 on the developing roll 73. Therefore, the developer on the developing roll 73 is prevented from coming into contact with the ventilation filter 81. Moreover, the position in which the ventilation filter 81 is disposed may be other than the extension line passing through any one of the magnetic poles within the magnet roll 77 from the rotational center O of the developing roll 73.

In addition, the opening portion 80 is provided on the downstream side in the rotating direction of the developing roll 73 from the photoreceptor drum 11. Thus, a zone in which air is affected to the ambient until air taken from the photoreceptor drum 11 by the developing roll 73 is discharged from the opening portion 80 is shorter than that of a case where the opening portion 80 is provided on an upstream side in the rotating direction of the developing roll 73 from the photoreceptor drum 11.

Another Configuration Example of Power Supply Applying Voltage to Ventilation Filter In the exemplary embodiment, the filter bias power supply 81*b* applies the voltage to the ventilation filter 81 and charges the charging portion 81*a* to the negative polarity. Here, the configuration to charge the ventilation filter 81 to the negative polarity is not limited to the configuration using the filter bias power supply 81*b*.

Figure 5:
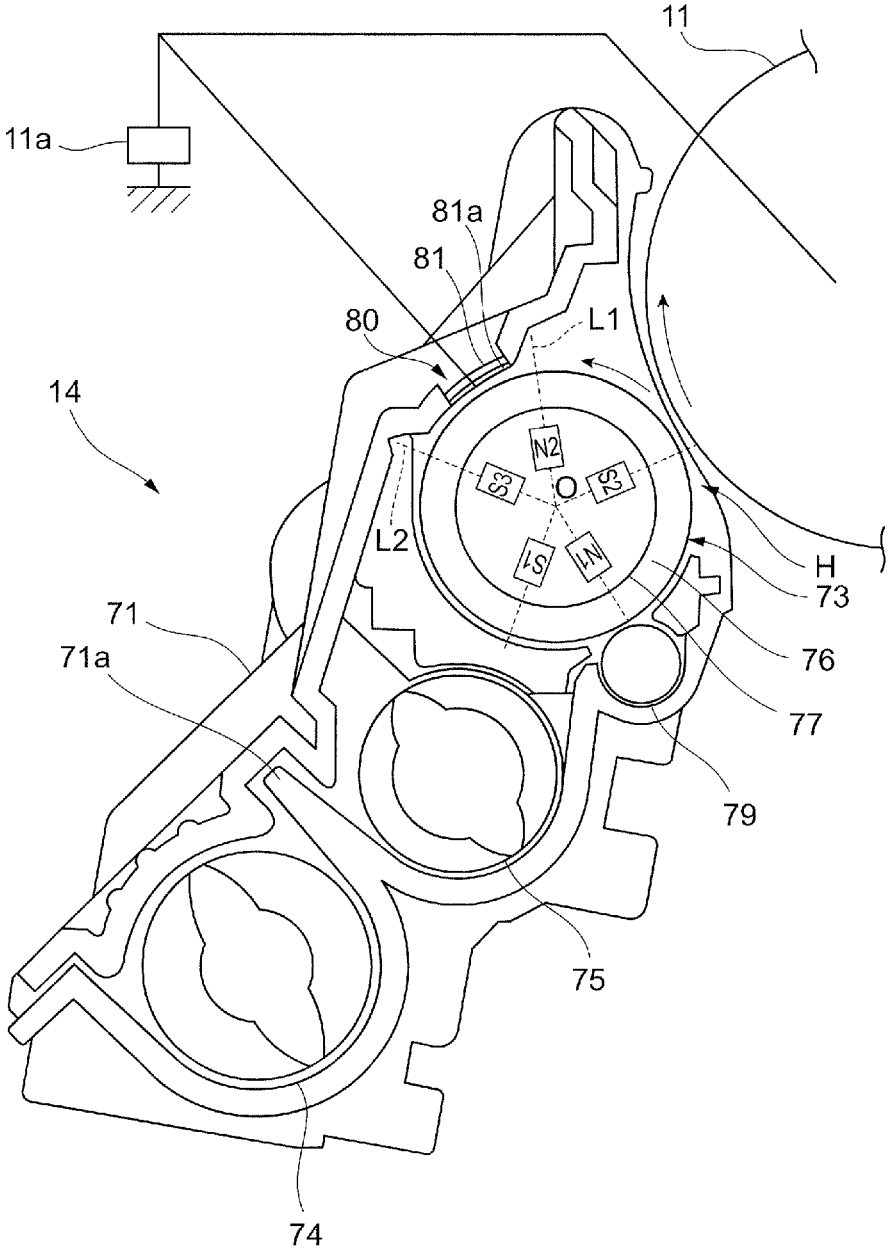
FIG. 5 is a view illustrating another configuration example of power supply applying a voltage to a ventilation filter.

For example, as illustrated in FIG. 5, the photoreceptor bias power supply 11*a* is also connected to the ventilation filter 81 in addition to the photoreceptor drum 11. Then, when performing development of the electrostatic latent image formed on the photoreceptor drum 11, the photoreceptor bias power supply 11*a* applies the voltage to the photoreceptor drum 11 and may apply the voltage to the ventilation filter 81. In this case, the photoreceptor bias power supply 11*a* is used as an example of voltage application member.

According to such a configuration, it is not necessary to independently provide a configuration for applying the voltage to the ventilation filter 81. In addition, both timing of applying the voltage to the photoreceptor drum 11 and timing of applying the voltage to the ventilation filter 81 are similar to timing of performing development of the electrostatic latent image. Thus, frequency of using the photoreceptor bias power supply 11*a* is not increased by the application of the voltage to the photoreceptor drum 11 and the application of the voltage to the ventilation filter 81.

Description of Movement of Toner and Carrier Positioned in Vicinity of Filter Having Semiconductive Property after Development Next, the movement of the toner T and the carrier C positioned in the vicinity of the ventilation filter 81 after development will be described.

FIGS. 6A, 6B, 6C, and 6D are views illustrating the movement of the toner T and the carrier C positioned in the vicinity of the ventilation filter 81 after development.

Figure 6A:
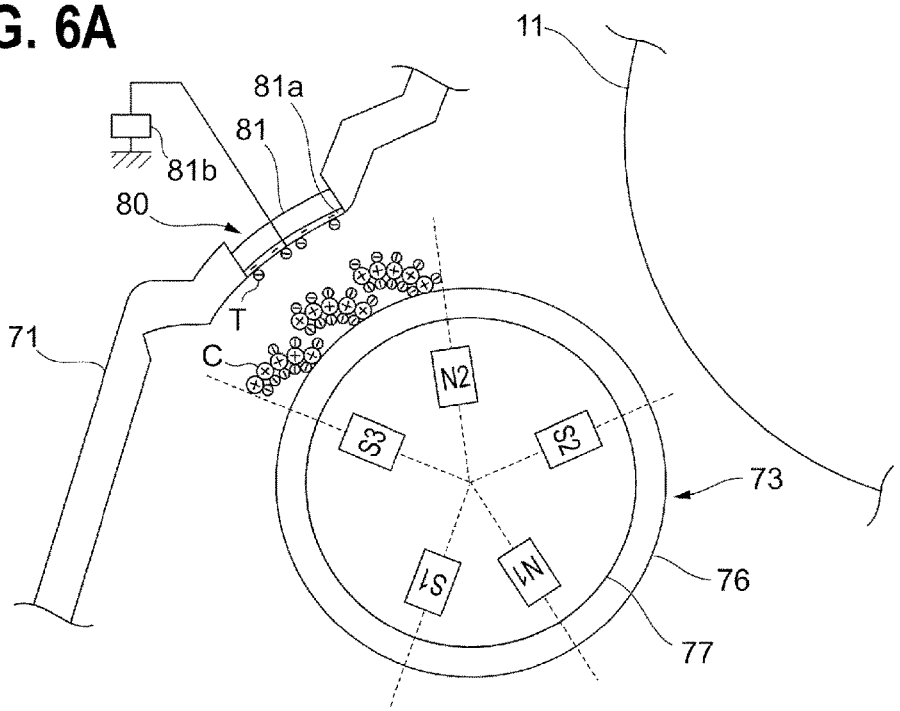
FIGS. 6A to 6D are views illustrating a movement of developer positioned in the vicinity of the ventilation filter after development.
Figure 6B:
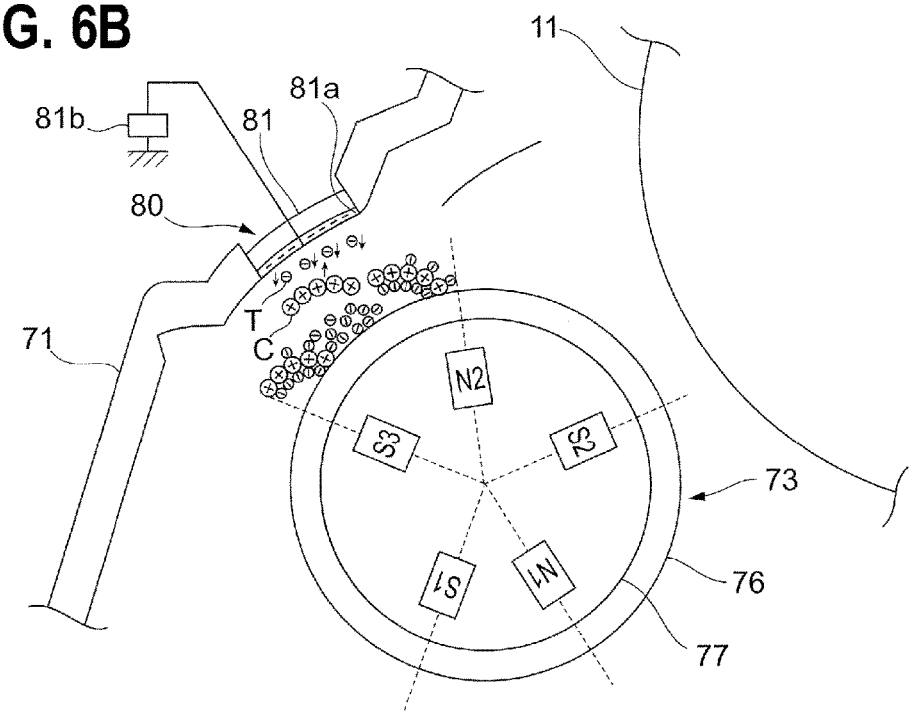
Figure 6C:
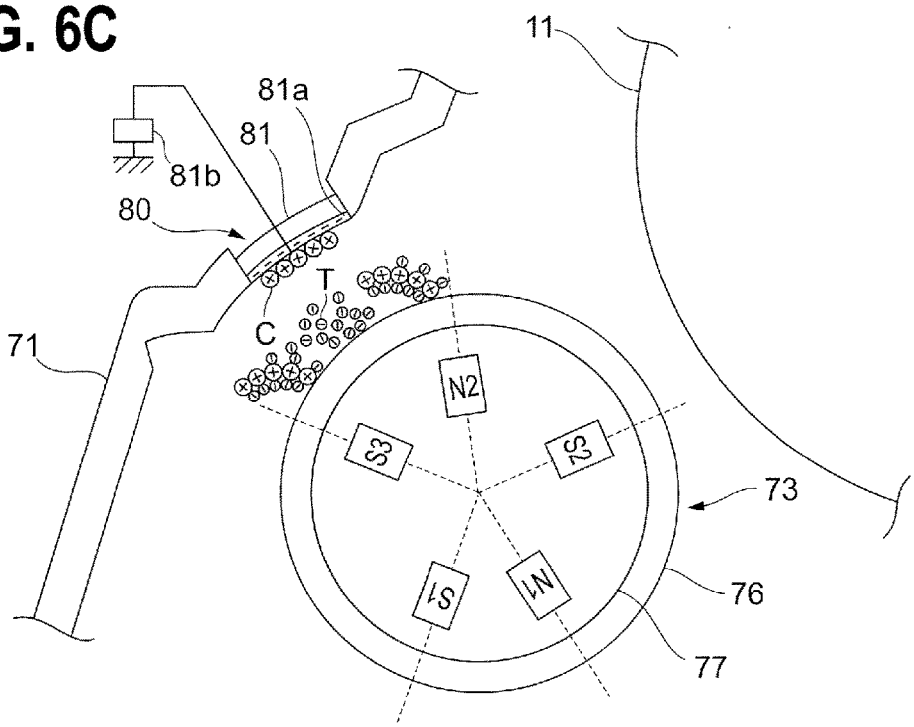
Figure 6D:
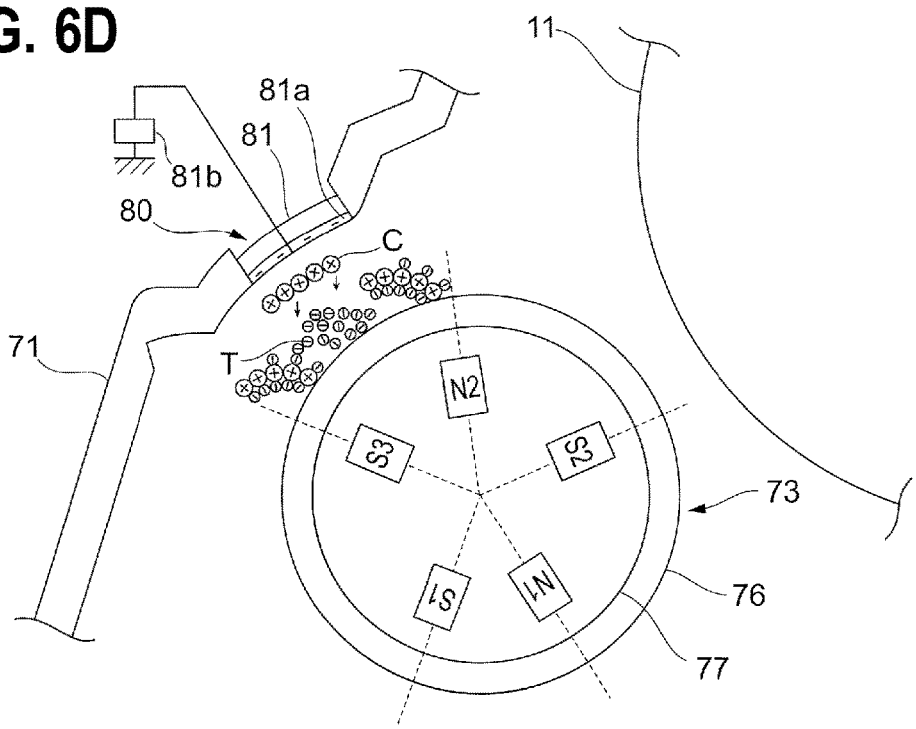

After development of the electrostatic latent image, the toner T scattered from the developing roll 73 and the like adheres to the ventilation filter 81 and clogging of the ventilation filter 81 may occur (see FIG. 6A). Then, first, for example, a voltage of −200 V is applied to the charging portion 81*a* by the filter bias power supply 81*b* or the photoreceptor bias power supply 11*a*. Therefore, the charging portion 81*a* is charged to the negative polarity stronger than that during development. Thus, the toner T adhering to the ventilation filter 81 receives the repulsive force and the gravity from the charging portion 81*a* and falls downward (see FIG. 6B).

On the other hand, the carrier C on the developing roll 73 receives an attractive force from the charging portion 81*a*. Then, the carrier C is moved to the charging portion 81*a*. Then, the carrier C adheres to the ventilation filter 81 (see FIG. 6C).

Here, in general, the carrier C is greatly larger than the toner T in size. Therefore, the carrier C does not enter the meshes of the filter even if the carrier C comes into contact with the ventilation filter 81. Therefore, clogging does not occur in the ventilation filter 81 due to the attraction of the carrier C.

Thereafter, as a voltage of substantially equal to that during development, for example, the voltage of −100 V is applied to the ventilation filter 81. Then, for a force acting on the carrier C coming into contact with the charging portion 81*a*, the gravity is greater than the attractive force from the charging portion 81*a*. Therefore, the carrier C is separated from the ventilation filter 81 and falls downward (see FIG. 6D). Then, the carrier C adheres to the developing roll 73 or falls downward from the developing roll 73.

In addition, after development, the developing roll 73 is not rotated and the air flow is further weakened than that during development. Therefore, the toner T existing in the vicinity of the ventilation filter 81 does not adhere to the ventilation filter 81 and falls by receiving the repulsive force from the charging portion 81*a*.

As described above, after development, a voltage, which is greater than a value that is set in a predetermined range as the value of the voltage applied to the ventilation filter 81 during development, is applied. Therefore, the toner T adhering to the ventilation filter 81 during development is pulled away from the ventilation filter 81 after development. Thus, it is possible to suppress that an amount of adhesion of the toner T to the filter is accumulated. In addition, after the toner T is fallen, the value of the voltage applied to the ventilation filter 81 is fallen substantially equal to that during development. Therefore, it is possible to suppress that a state where the carrier C adheres to the ventilation filter 81 is maintained.

Moreover, in the exemplary embodiment, the image forming apparatus 1 that forms the color image is described, but it is possible to apply each configuration described above even in the image forming apparatus 1 that forms a single color image such as black (K).

In addition, in the exemplary embodiment, an example in which two-component developer including the toner T and the carrier C is used as the developer is described, but the invention is not limited to the example. For example, the invention may apply to a case where one-component developer not including the carrier C containing the toner T is used as the developer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer holding member that holds developer including toner which is charged to have a predetermined polarity on a surface of the developer holding member and performs development of an electrostatic latent image with respect to an image holding member which holds the electrostatic latent image while being rotated;

a storage member that stores the developer therein and has an opening portion for discharging air in which flow is generated by the rotation of the developer holding member; and a collection member that is provided in the opening portion of the storage member to be charged to the predetermined polarity, causes air to pass therethrough, and collects toner, wherein the developer holding member has a plurality of magnetic poles inside, and wherein the collection member is provided within two adjacent extension lines which pass through two magnetic poles, respectively, of the plurality of magnetic poles from a rotational center of the developer holding member, each of the two magnetic poles being adjacent with each other and having different magnetic polarities with each other.

2. The developing device according to claim 1, wherein the collection member is provided above the developer holding member and is oriented downward.

3. The developing device according to claim 1, further comprising:

a voltage application member that applies a voltage to the image holding member and the collection member, and charges the image holding member and the collection member to the predetermined polarity.

4. The developing device according to claim 2, further comprising:

a voltage application member that applies a voltage to the image holding member and the collection member, and charges the image holding member and the collection member to the predetermined polarity.

5. The developing device according to claim 1, wherein a voltage with a value of a predetermined range is applied to the collection member during development of the electrostatic latent image and a voltage of a value greater than the predetermined range is applied to the collection member after development of the electrostatic latent image.

6. The developing device according to claim 2, wherein a voltage with a value of a predetermined range is applied to the collection member during development of the electrostatic latent image and a voltage of a value greater than the predetermined range is applied to the collection member after development of the electrostatic latent image.

7. The developing device according to claim 3, wherein a voltage with a value of a predetermined range is applied to the collection member during development of the electrostatic latent image and a voltage of a value greater than the predetermined range is applied to the collection member after development of the electrostatic latent image.

8. The developing device according to claim 4, wherein a voltage with a value of a predetermined range is applied to the collection member during development of the electrostatic latent image and a voltage of a value greater than the predetermined range is applied to the collection member after development of the electrostatic latent image.

9. An image forming apparatus comprising:

an image forming portion that forms an image on a recording material;

a developer holding member that holds developer including toner which is charged to have a predetermined polarity on a surface of the developer holding member and performs development of an electrostatic latent image with respect to an image holding member which holds the electrostatic latent image while being rotated;

a storage member that stores the developer therein and has an opening portion for discharging air in which flow is generated by the rotation of the developer holding member;

a collection member that is provided in the opening portion of the storage member to be charged to have the predetermined polarity, causes air to pass therethrough, and collects toner; and a voltage application member that applies a voltage with respect to the collection member, wherein the developer holding member has a plurality of magnetic poles inside, and wherein the collection member is provided within two adjacent extension lines which pass through two magnetic poles, respectively, of the plurality of magnetic poles from a rotational center of the developer holding member, each of the two magnetic poles being adjacent with each other and having different magnetic polarities with each other.

10. The developing device according to claim 1, wherein the opening portion of the storage member faces to the developer holding member, and the storage member has an inclined surface on an upstream side of the opening portion in a rotating direction of the developer holding member, the inclined surface being separate from the developer holding member with distance from the opening portion.

11. The developing device according to claim 10, wherein the opening portion of the storage member is positioned in an area where a distance between an inner surface of the storage member and the developer holding member is the narrowest.

12. The developing device according to claim 11, wherein the opening portion of the storage member is positioned in an upstream side end of the area.

13. The image forming apparatus according to claim 9, wherein the opening portion of the storage member faces to the developer holding member, and the storage member has an inclined surface on an upstream side of the opening portion in a rotating direction of the developer holding member, the inclined surface being separate from the developer holding member with distance from the opening portion.

14. The image forming apparatus according to claim 13, wherein the opening portion of the storage member is positioned in an area where a distance between an inner surface of the storage member and the developer holding member is the narrowest.

15. The image forming apparatus according to claim 14, wherein the opening portion of the storage member is positioned in an upstream side end of the area.

* * * * *